US010253447B2

(12) United States Patent
Hwang et al.

(10) Patent No.: US 10,253,447 B2
(45) Date of Patent: Apr. 9, 2019

(54) WASHING MACHINE

(71) Applicant: Dongbu Daewoo Electronics Corporation, Seoul (KR)

(72) Inventors: Ui Kun Hwang, Seoul (KR); Jong Oh Park, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 213 days.

(21) Appl. No.: 15/265,644

(22) Filed: Sep. 14, 2016

(65) Prior Publication Data

US 2017/0233938 A1 Aug. 17, 2017

(30) Foreign Application Priority Data

Feb. 16, 2016 (KR) ..... 10-2016-0017722

(51) Int. Cl.
*D06F 39/10* (2006.01)
*D06F 39/08* (2006.01)

(52) U.S. Cl.
CPC ..... *D06F 39/10* (2013.01); *D06F 39/083* (2013.01); *D06F 39/085* (2013.01)

(58) Field of Classification Search
CPC ..... D06F 39/083; D06F 39/10
See application file for complete search history.

(56) References Cited

U.S. PATENT DOCUMENTS

2005/0120758 A1* 6/2005 Thies ..... D06F 39/10 68/18 R
2012/0186306 A1* 7/2012 Kim ..... D06F 39/10 68/18 F
2013/0125596 A1* 5/2013 Ushijima ..... D06F 39/083 68/139
2013/0276484 A1* 10/2013 Mantle ..... D06F 39/10 68/18 F
2014/0238089 A1* 8/2014 Jeong ..... D06F 39/10 68/18 F
2015/0225888 A1* 8/2015 Kim ..... D06F 39/10 68/18 F
2016/0186370 A1* 6/2016 Kim ..... D06F 39/02 68/17 R
2017/0101733 A1* 4/2017 Jung ..... D06F 37/22
2017/0101734 A1* 4/2017 Jung ..... D06F 37/22
2017/0107657 A1* 4/2017 Kim ..... D06F 39/022

* cited by examiner

*Primary Examiner* — Joseph L. Perrin

(57) ABSTRACT

A washing machine, comprises a washing tub; a drain port; and a circulation device which is driven to return the water from the branch part to the washing tub; and a branch part. The branch part includes a filter accommodation member for accommodating a removable filter. The washing tub includes: an outflow port through which the washing water flows out; and an inflow port through which the washing water flowing out from the outflow port is returned to the washing tub. The branch part further includes: a circulation device accommodation member configured to accommodate the circulation device; a first port coupled to the outflow port; a second port coupled to the inflow port and provided in the circulation device accommodation member; and a third port coupled to the drain port. The filter includes a filter member disposed on the side of the circulation device accommodation member.

14 Claims, 7 Drawing Sheets

WASHING MACHINE

CROSS-REFERENCE TO RELATED APPLICATIONS

This application is based on and claims priority from Korean Patent Application No. 10-2016-0017722, filed on Feb. 16, 2016, the disclosure of which is incorporated herein in its entirety by reference.

TECHNICAL FIELD

The present disclosure relates to washing machines, and more particularly, relates to filters in washing machines.

BACKGROUND

A washing machine is an apparatus used for washing and cleaning laundry by friction between laundry and washing water. During operation, a water tub containing the laundry rotates to generate the friction. Typically, a drum washing machine cleans laundry by lifting and dropping the laundry while the washing tub rotates; a vertical-shaft washing machine generates a strong water flow for washing the laundry through the rotation of a washing tub.

A washing machine discharges water from the washing tub to the outside after the washing cycle. The water can then recycle back to the washing tub. However after a washing cycle, washing water can be discharged from the water tub (e.g., in a spin-dry cycle) and drained out of the washing machine. Washing water discharged from the washing tub is either returned to the washing tub via a branch part through a return device in a return process or drained out of the washing machine via the branch part through a drain device in a spin-dry process.

To prevent extraneous materials in the water from clogging the water paths coupled to the return device and the drain device, a filter is installed within the branch part to filter the loose materials, such as dirt, small objects, or the like.

Unfortunately, according to the conventional art, the filter used in the branch part tends to restrict the water flow, thereby causing the drain process to be slow.

SUMMARY

Accordingly, embodiments of the present disclosure provide a washing machine capable of draining washing water with improved water flow rate.

According to an embodiment of the present invention, a washing machine includes: a washing tub into which washing water is supplied to wash a washing object (e.g., laundry); a drain port through which the washing water is drained to the outside of the washing machine; and a circulation device used to drive the return of water from a branch part to the washing tub; and the branch part includes a filter accommodation member configured to removably accommodate a filter. The washing tub includes an outflow port through which the washing water flows out and an inflow port through which the washing water flowing out from the outflow port is returned and supplied to the washing tub. The branch part includes: a circulation device accommodation member configured to accommodate the circulation device; a first port coupled to the outflow port; a second port coupled to the inflow port and provided in the circulation device accommodation member; and a third port coupled to the drain port. The filter includes a filter member disposed on the side of the circulation device accommodation member.

Further, the washing machine includes a drain device used to drive the discharge of washing water from the branch part to the drain port. A filter mount used to accommodate a removable filter is provided in a front portion of the branch part. A drain device accommodation member which accommodates the drain device is formed in a rear portion of the branch part.

Further, the circulation device accommodation member is disposed on one side portion of the branch part. The first port is disposed in the other side portion of the branch part opposite to the one side portion.

Further, the filter includes a filter bar extending from the side of the filter mount toward the drain device accommodation member.

Further, the filter includes a discharge member provided at the side of the drain device accommodation member and provided with a discharge hole. The filter bar extends so as to be inserted into the discharge member.

Also in one embodiment of the present invention, a washing machine includes: a washing tub into which washing water is supplied to wash washing objects; a drain port through which the washing water is drained to the outside of the washing machine; a circulation device which is driven to return the water introduced into a branch part to the washing tub; and the branch part includes a filter accommodation member configured to removably accommodate a filter. The washing tub includes an outflow port through which the washing water flows out and an inflow port through which the washing water flowing out from the outflow port is returned and supplied to the washing tub. The branch part includes: a circulation device accommodation member configured to accommodate the circulation device, a first port coupled to the outflow port, a second port coupled to the inflow port and provided in the circulation device accommodation member and a third port coupled to the drain port.

The filter includes a filter member configured to filter out extraneous materials in the washing water introduced from the first port. The filter includes a first positioning member. The filter accommodation member includes a second positioning member formed in a position corresponding to the first positioning member. The first positioning member and the second positioning member are configured to interplay to prevent rotation of the filter member when the filter is mounted to or demounted from the filter accommodation member.

Further, the filter member is disposed on the side of the circulation device accommodation member.

Further, the filter includes: a filter bar extending from the side of a filter mount toward a drain device accommodation member; and a discharge member provided at the side of the drain device accommodation member and provided with a discharge hole. The filter bar and the discharge hole are configured to prevent extraneous materials existing in the washing water from flowing into the drain device accommodation member.

Embodiments of the present disclosure advantageously provide a washing machine capable of draining washing water with improved water flow rate

DETAILED DESCRIPTION

Figure 1:
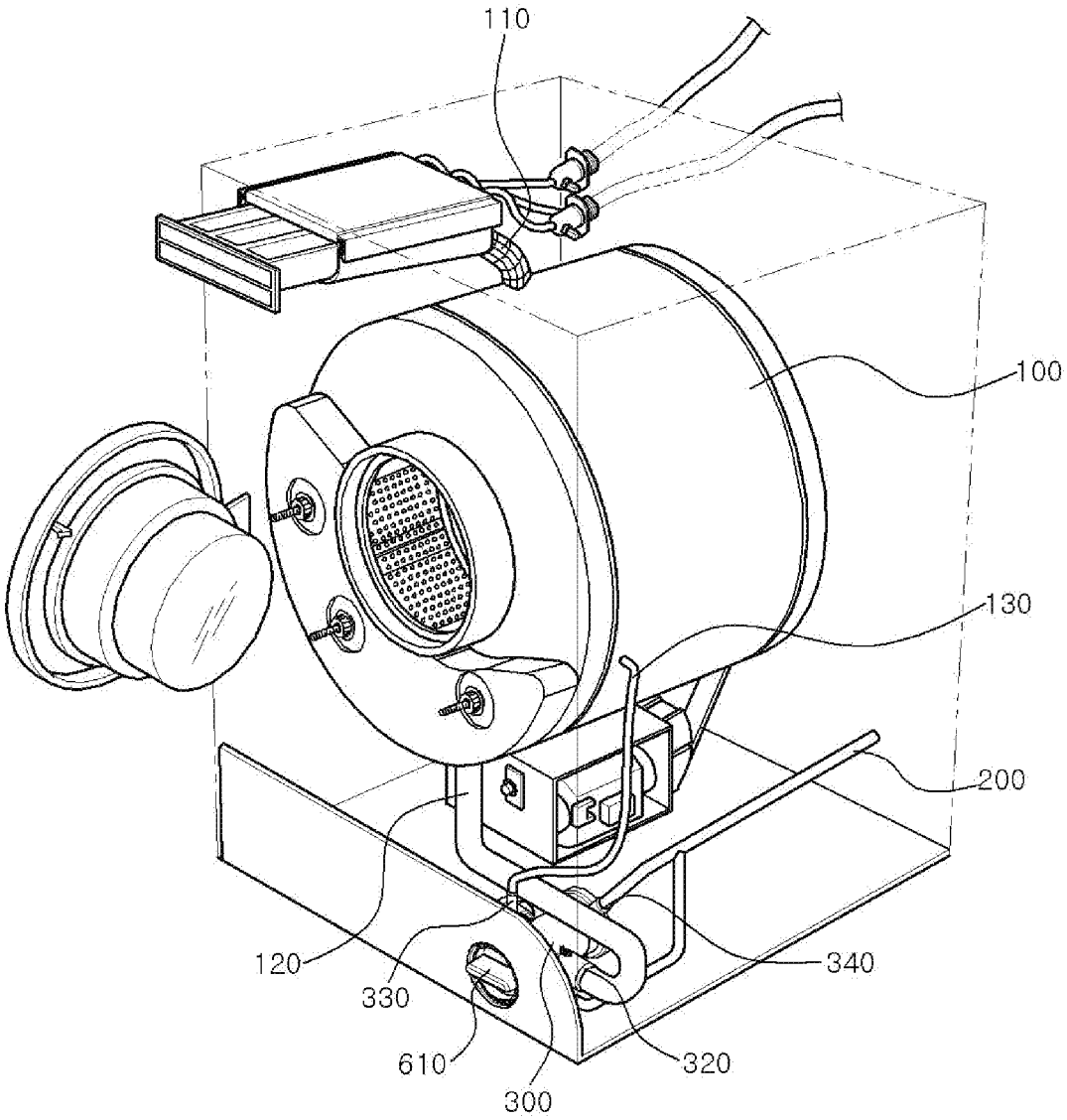
FIG. 1 is a perspective view illustrating the configuration of an exemplary washing machine according to one embodiment of the present disclosure.
Figure 2:
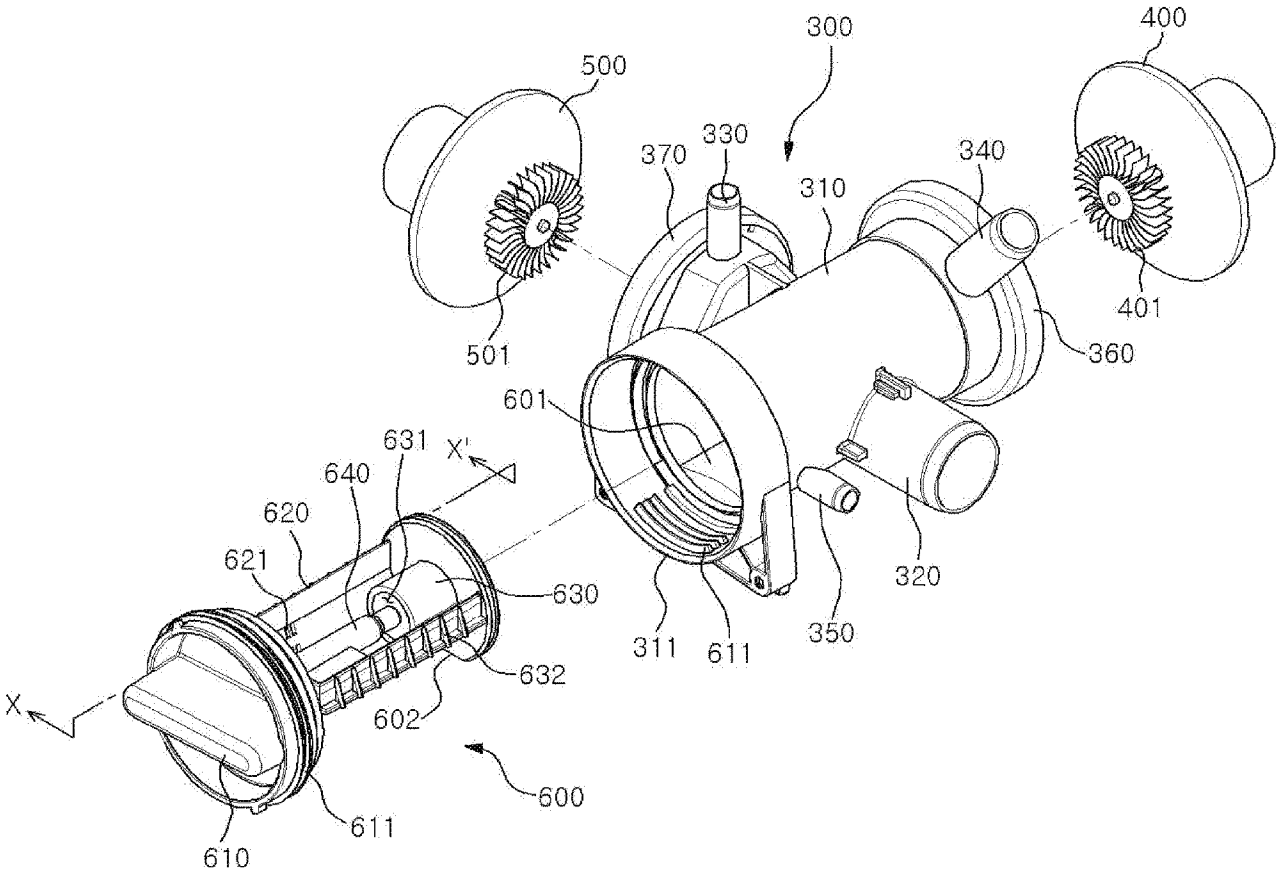
FIG. 2 is an exploded perspective view illustrating an exemplary branch part of the washing machine illustrated in FIG. 1.
Figure 3A:
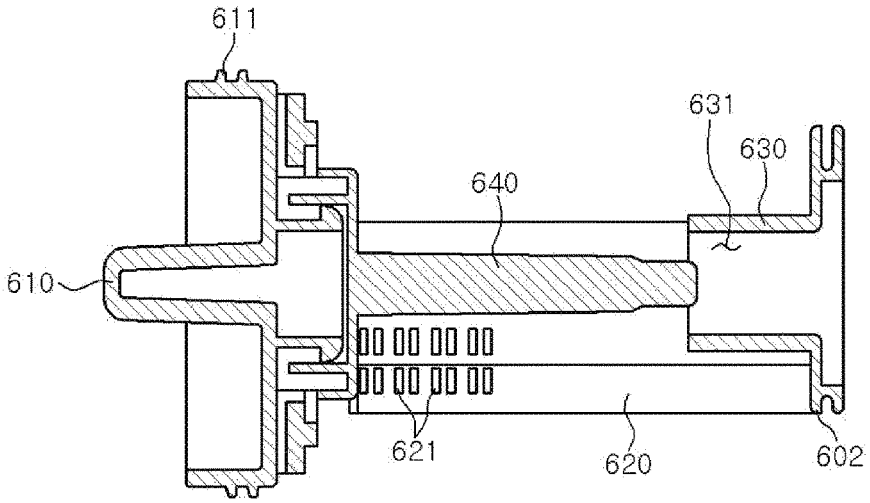
FIG. 3A is a sectional view of an exemplary filter taken along line X-X in FIG. 2.
Figure 3B:
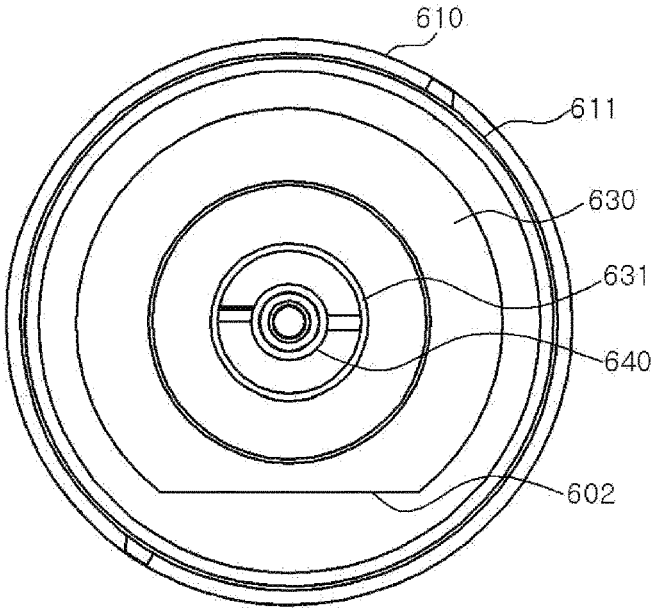
FIG. 3B is a rear view of the filter illustrated in FIG. 2.
Figure 4:
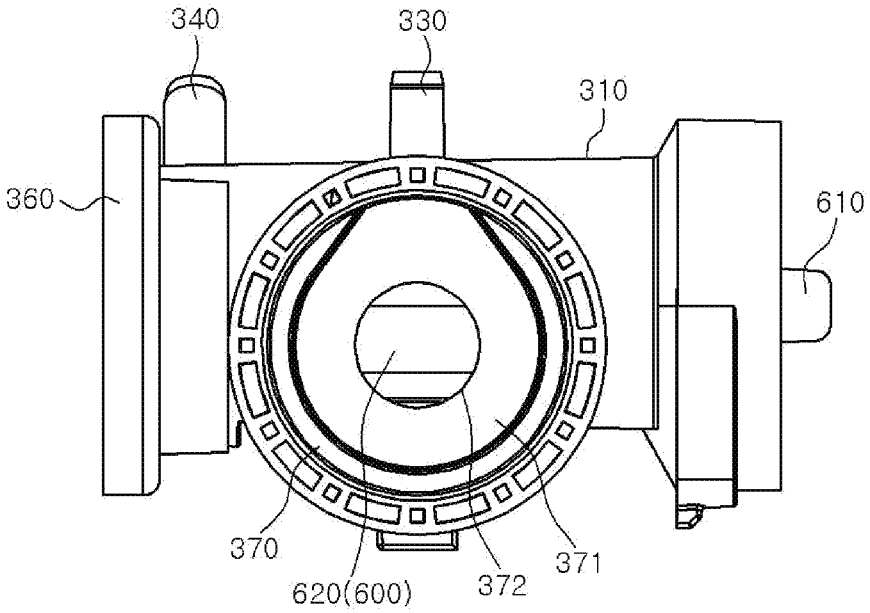
FIG. 4 is a side view of the exemplary branch part illustrated in FIG. 2.
Figure 5:
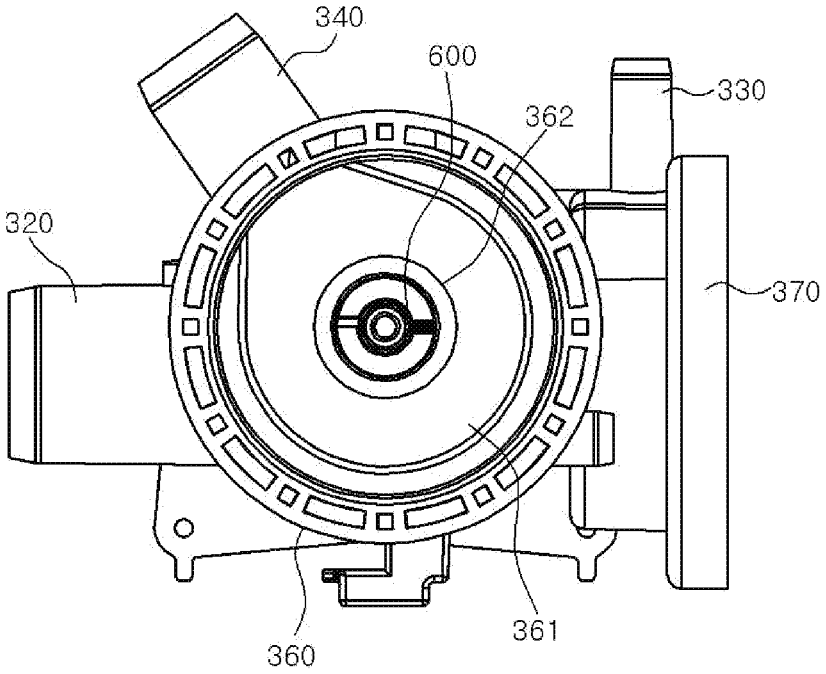
FIG. 5 is a rear view of the exemplary branch part illustrated in FIG. 2.

Embodiments of the present invention will be better understood from a reading of the following detailed description, taken in conjunction with the accompanying figures, in which like reference characters designate like elements and in which:

The configuration of an exemplary branch part according to one embodiment of the present disclosure is described with reference to FIGS. 1 to 5. FIG. 1 illustrates a perspective view of an exemplary structure of a washing machine according to one embodiment of the present disclosure. FIG. 2 is an exploded perspective view illustrating an exemplary branch part of the washing machine illustrated in FIG. 1. FIG. 3A is a sectional view of an exemplary filter taken along line X-X in FIG. 2. FIG. 3B is a rear view of the exemplary filter illustrated in FIG. 2. FIG. 4 is a side view of the exemplary branch part illustrated in FIG. 2. FIG. 5 is a rear view of the exemplary branch part illustrated in FIG. 2.

Referring to FIGS. 1 to 5, the washing machine 10 includes: a washing tub 100 used to contain laundry or other objects for washing; a drain port 200 through which water is drained to the outside of the washing machine 100; a branch part 300 through which water discharged from the washing tub 100 flows back to the washing tub 100 or drained through the drain port 200; a drain device 400 which provides the drive power for sending water from the branch part 300 to the drain port 200; and a circulation device 500 which provides the drive power for returning water from the branch part 300 to the washing tub 100.

The washing tub 100 includes a supply port 110, an outflow port 120 and an inflow port 130. Washing water is introduced from the external water source into the washing tub 100 through the supply port 110. Water in the washing tub 100 can be discharged through the outflow port 120. The outflow port 120 may be located at the bottom of the washing tub 100, which enables water to be discharged quickly. One or more of the drain device 400 and the circulation device 500 may drive the discharge. Water flowing out from the outflow port 120 of the washing tub 100 may flow to the drain port 200 via the branch part 300 or to the inflow port 130 via the branch part 300.

In the illustrated configuration, the inflow port 130 and the supply port 110 are separate ports. This configuration is only exemplary. In some other embodiments, the supply port 110 may not be included, and the inflow port 130 may be configured to allow water supplied from the outside and water returned from the branch part 300 to pass through.

Water flowing out from the washing tub 100 is drained to the outside of the washing machine 10 through the drain port 200. In one example, the drain port 200 may be located at the lower side of the washing machine 10 and may include a hose.

The branch part 300 is coupled to the outflow port 120 to receive water discharged from the washing tub 100. The branch part 300 is coupled to the inflow port 130 and the drain port 200. Water flowing to the branch part 300 can be returned to the washing tub 100 through the inflow port or drained to the outside of the washing machine 10 through the drain port 200.

The branch part 300 includes a filter accommodation member 310 for accommodating a filter 600, a first port 320 coupled to the outflow port 120, a second port 330 coupled to the inflow port 130, a third port 340 coupled to the drain port 200, a fourth port 350 through which water remaining in the filter accommodation member 310 can be discharged, a drain device accommodation member 360 which accommodates the drain device 400, and a circulation device accommodation member 370 which accommodates the circulation device 500.

The filter accommodation member 310 is configured to accommodate a filter 600. Extraneous materials such as dust and the like present in the water coming from the washing tub 100 can be retained by the filter 600.

The first port 320 may be disposed on one side of the branch part 300. As an example, the first port 320 may extend horizontally when the washing machine 10 is placed in an operational position. The first port 320 is coupled to the filter accommodation member 310. Water flowing through the outflow port 120 may be supplied into the filter accommodation member 310 through the first port 320. For example, the first port 320 may extend in a first direction that is substantially perpendicular to an elongated direction of the branch part 300 (or the axial direction). The circulation device accommodation member 370 may be installed on the opposite side of the branch part 300. The size of the first port 320 may be smaller than the size of the second port 330 and the third port 340. In addition, the first port 320 may be coupled to the outflow port 120 via a hose. The front part of the branch part 300 (with reference to the orientation shown in FIG. 2) may face toward the outside of the washing machine 10.

The second port 330 may be disposed in the upper portion of the circulation device accommodation member 370 that is installed on a different side of the branch part 300 than the first port 320. The second port 330 is coupled to the inflow port 130 of the washing tub 100. Water in the branch part 300 is supplied to the inflow port 130 through the second port 330. As an example, the second port 330 may extend upward. For example, the second port 330 may extend in a second direction oriented toward the upper side of the branch part 300. In this regard, the upper side of the branch part 300 faces the same direction as the upper side of the washing machine 10. The second direction may be substantially perpendicular to elongated direction of the branch part 300 and may also be substantially perpendicular to the extension direction of the first port 320.

Furthermore, the second port 330 may be smaller than the size of the first port 320 and the third port 340. Moreover, the second port 330 may be coupled to the inflow port 130 via a hose.

The third port 340 may be formed in the upper portion of the drain device accommodation member 360 that is installed in the rear portion of the branch part 300. The third port 340 may extend in a third direction which deviates from the second direction in a predetermined angle. As an example, the third port 340 may be oriented in an acute angle from the vertical orientation, for example, about 45 degrees. The third port 340 is coupled to the drain port 200. Water can be discharged from the branch part 300 to the drain port 200 through the third port 340.

The fourth port 350 is disposed in a lower region of one side of the branch part 300. The filter accommodation member 310 of the branch part 300 communicates with the outside through the fourth port 350. The fourth port 350 is coupled to the drain port 200. Water can be discharged from the branch part 300 to the drain port 200 through the fourth port 350.

The drain device accommodation member 360 may include a housing which accommodates a below-mentioned drain device impeller 401 of the drain device 400. For example, the front side of the branch part 300 is installed with a filter mount 311 and interfaces with the outside of the washing machine 10. The drain device accommodation member 360 may be installed on the rear side of the branch part 300. The drain device accommodation member 360 is separated from the filter accommodation member 310 by a drain device partition wall 361. A drain device through-hole 362 may be disposed in the central portion of the drain device partition wall 361. The drain device through-hole 362 allows water to flow between the filter accommodation member 310 and the drain device accommodation member 360. As an example, the drain device partition wall 361 and the drain device through-hole 362 may have a circular shape. The radius of the drain device through-hole 362 may be about one half of the radius of the drain device partition wall 361 for example. Water can flow from the filter accommodation member 310 into the drain device accommodation member 360 through the drain device through-hole 362. Then, water can be discharged from the drain device accommodation member 360 through the third port 340 as the drain device impeller 401 rotates.

The circulation device accommodation member 370 may include a housing which accommodates a below-mentioned circulation device impeller 501 in the circulation device 500. For example, a filter mount 311 is installed on the front side of the branch part 200, e.g., the front side facing outside of the washing machine 10. The first port 320 is installed on a first side of the branch part, and the circulation device accommodation member 370 may be installed on a second side of the branch part 300 that is opposite to the first side. The circulation device accommodation member 370 is separated from the filter accommodation member 310 by a circulation device partition wall 371.

A circulation device through-hole 372 which brings the filter accommodation member 310 and the circulation device accommodation member 370 into communication with each other may be disposed in the central portion of the circulation device partition wall 371. As an example, the circulation device partition wall 371 and the circulation device through-hole 372 may have a circular shape. The radius of the circulation device through-hole 372 may be about one half of the radius of the circulation device partition wall 371. Water flowing from the filter accommodation member 310 enters the circulation device accommodation member 370 through the circulation device through-hole 372. Then, water in the circulation device accommodation member 370 is discharged through the second port 330 as the circulation device impeller 501 rotates.

A filter 600 is installed within the branch part 300. The filter 600 may be removably mounted through a filter mount 311 that is installed in the front side of the branch part 300. The filter 600 includes a head portion 610, a filter member 620, a discharge member 630 and a filter bar 640.

The head portion 610 may be selectively coupled to the filter mount 311 by a coupling means 610. The head portion 610 may be rotatably installed in the filter 600. For example, the head portion 610 may be rotatable relative to the filter member 620. The coupling means 611 may be a thread coupler. However, the present disclosure is not limited thereto.

The filter member 620 may have filter holes 621 and can filter out extraneous material in the water. The filter member 620 may be located on the side of the circulation device accommodation member 370 when the filter 600 is inserted into the filter accommodation member 310. In other words, the filter member 620 can cover the circulation device through-hole 372 disposed between the filter accommodation member 310 and the circulation device accommodation member 370.

The filter holes 621 of the filter member 620 may be located on the side of the filter mount 311. For example, when the filter 600 is fastened to the branch part 300, the filter holes 621 are positioned on the front side of the circulation device through-hole 372 and the first port 320. Thus, if a user views the first port 320 of the branch part 300 with the filter 600 fastened to the branch part 300, the filter holes 621 may not be visible. In other words, if a user views the first port 320 of the branch part 300 with the filter 600 fastened to the branch part 300, the circulation device through-hole 372 may be blocked by the filter member 620 and may be invisible.

Accordingly, water flowing into the filter accommodation member 310 is not directly discharged toward the circulation device accommodation member 370 but flows out after going around the filter mount 311. In other words, water entering the filter accommodation member 310 flows toward the filter mount 311 and passes through the filter holes 621. Thereafter, water flows backward toward the circulation device accommodation member 370 and passes through the circulation device through-hole 372. Then, the water is discharged to the circulation device accommodation member 370.

The discharge member 630 may be disposed on the side of the drain device accommodation member 360. The discharge member 630 has a discharge hole 631. The discharge hole 631 is larger than the size of the filter holes 621 of the filter member 620. Furthermore, the discharge member 630 may be coupled to the head portion 610 via a reinforcing member 632. As an example, the discharge member 630 may include one cylindrical member, in which case the interior of the cylinder may serve as the discharge hole 631. Water flowing into the filter accommodation member 310 may flow out toward the drain device accommodation member 360 through the discharge hole 631.

The filter bar 640 may be inserted into the discharge hole 631 of the discharge member 630. Furthermore, the filter bar 640 may be rod-shaped extending from the side of the filter mount 311 toward the drain device accommodation member 360. The filter bar 640 and the discharge hole 631 may prevent extraneous material in the water having a relatively large size, such as a coin and the like, from flowing into the drain device accommodation member 360.

The filter accommodation member 310 and the filter 600 respectively use the first and second positioning portions 601 and 602 to ensure the filter 600 to be positioned in the filter accommodation member 310 in a predetermined orientation. When the head portion 610 is rotated to mount or remove the filter 600, the interplay between the first and second positioning portions 601 and 602 prevents rotation of the filter member 620. In other words, the filter 600 can be mounted to or removed from the filter accommodation member 310 as the filter 600 moves forward or backward along the positioning portions 601 and 602. Thus, even when the head portion 610 is rotated, the filter member 620 does not rotate but moves forward or backward along the axial direction of the first positioning portion 601. Accordingly, when the filter 600 is placed in the branch part 300, the position of the filter member 620 can be easily maintained on the side of the circulation device accommodation member 370. In the drawings illustrating the present embodiment, the first positioning portion 601 is a protruding member on the edge of the branch part 300 and extends along the axial direction of the branch part 300. The second positioning portion 602 has a cutout which matches with the protruding shape of the first positioning portion 601. However, the present disclosure is not limited thereto.

The drain device 400 may include a drain device impeller 401 and a drive unit. The drain device impeller 401 may be accommodated within the drain device accommodation member 360. The drain device 400 and the drain device accommodation member 360 are located in the rear portion of the branch part 300. The drain device 400 provides the drive power for discharging water from the branch part 300 to the second port 330. Water in the branch part 300 may be discharged to the second port 330 through the drain device accommodation member 360 by the drain device 400. For example, the drain device 400 may be a discharge pump. However, the present disclosure is not limited thereto.

The circulation device 500 may include a circulation device impeller 501 and a drive unit. The circulation device impeller 501 may be accommodated within the circulation device accommodation member 370. The circulation device 500 provides the drive power for discharging water from the branch part 300 to the third port 340. Water in the branch part 300 may be discharged to the third port 340 through the circulation device through-hole 372 and the circulation device accommodation member 370 by the circulation device 500. For example, the drain device 400 may be a discharge pump. However, the present disclosure is not limited thereto.

Figure 6:
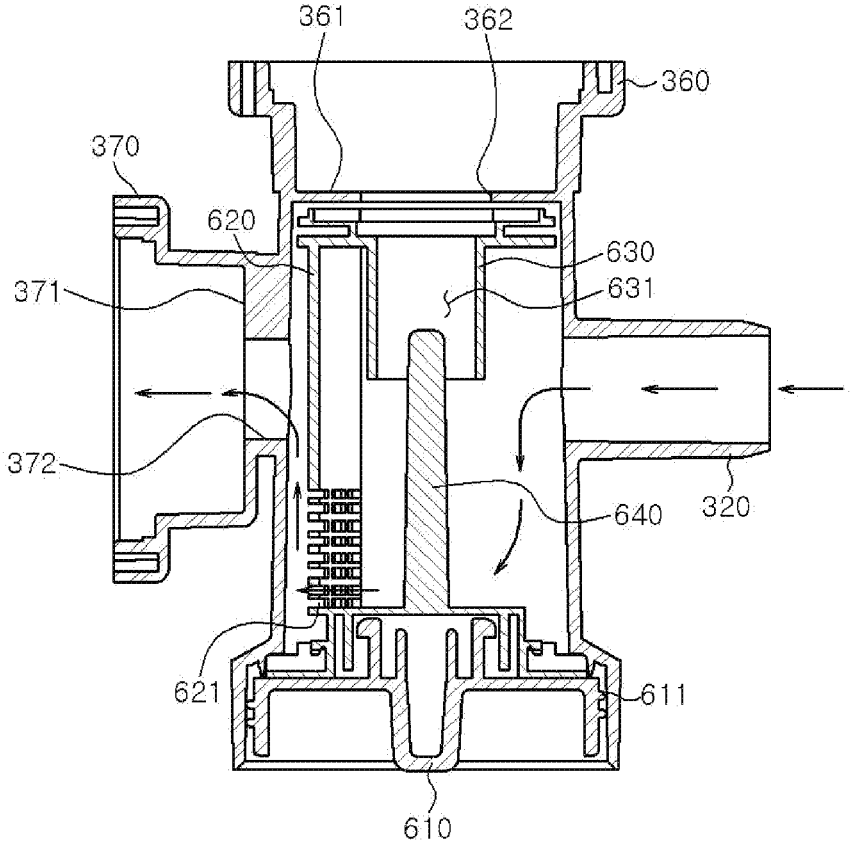
FIG. 6 illustrates an exemplary flow of washing water within the branch part during a return process.

The operation and effects of the washing machine 10 configured as above are described with reference to FIGS. 6 and 7. Arrows in FIG. 6 illustrate the flow of washing water within the branch part during a return process. Arrows in FIG. 7 illustrate the flow of washing water within the branch part during a drain process.

Figure 7:
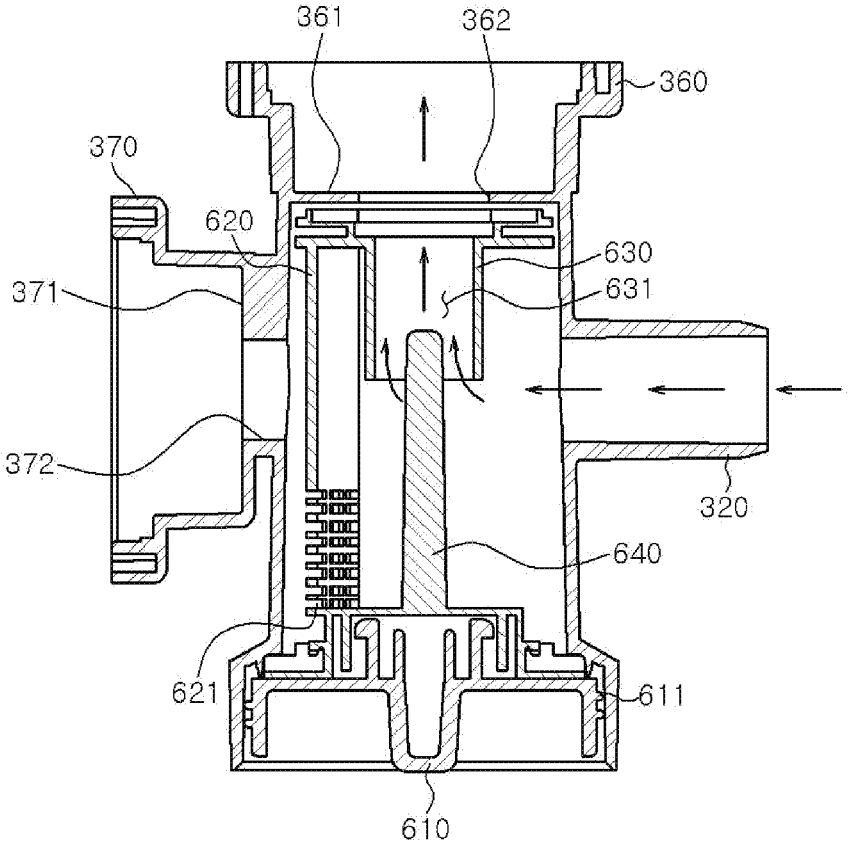
FIG. 7 illustrates an exemplary flow of washing water within the branch part during a drain process.

Referring to FIGS. 6 and 7, during operation, the washing machine 10 is supplied with water from the outside. Water flows into the washing tub 100 through the supply port 110.

Water flowing into the washing tub 100 may circulate through the branch part 300 during a washing process. Hereinafter, the circulation process will be described with reference to FIG. 6.

Water in the washing tub 100 can be discharged through the outflow port 120 of the washing tub 100 and flows into the branch part 300 through the first port 320. The water passes through the first port 320 and flows into the filter accommodation member 310. The water in the filter accommodation member 310 flows into the circulation device accommodation member 370 through the circulation device through-hole 372. The circulation device 500 is installed in the circulation device accommodation member 370 and is configured to discharge water flowing into the circulation device accommodation member 370 to the second port 330. Water discharged through the second port 330 is supplied back to the washing tub 100 through the inflow port 130 of the washing tub 100.

In the circulation process, washing water is not directly discharged toward the circulation device accommodation member 370 but flows out by going around the filter mount 311. In other words, water flowing into the filter accommodation member 310 in the circulation process flows forward and toward the filter mount 311 and passes through the filter holes 621. Thereafter, water flows backward toward the circulation device accommodation member 370 and passes through the circulation device through-hole 372. Then, water is discharged to the circulation device accommodation member 370. This detoured flow enables the filter member 620 to effectively filter out the extraneous material contained in the returned washing water.

Water in the washing tub 100 may also be drained through the branch part 300 in a drain process. Hereinafter, the drain process will be described with reference to FIG. 7.

Water in the washing tub 100 is discharged through the outflow port 120 of the washing tub 100 and then flows into the branch part 300 through the first port 320. The water passes the first port 320 and flows into the filter accommodation member 310. Water in the filter accommodation member 310 flows into the drain device accommodation member 360 through the drain device through-hole 362. The drain device 400 is disposed in the drain device accommodation member 360 and is configured to discharge water from the drain device accommodation member 360 to the third port 340. The water passes the third port 340 and is drained to the outside of the washing machine 10 through the drain port 200.

In the drain process, most of the washing water flows out toward the drain device accommodation member 360 through the discharge hole 631 without going through the filter holes 621 of the filter member 620. As the flow of the washing water is not hindered by the filter member 620, water can be drained from the branch part 300 at a high flow rate.

In the drain process, the washing water is drained to the outside of the washing machine 10. Most of the extraneous material contained in the washing water is drained to the outside of the washing machine 10 together with the washing water. Since most of the washing water is drained without going through the filter member 620 in the drain process, the extraneous material contained in the washing water is also drained without going through the filter member 620. Accordingly, the extraneous material would not build up on the filter member 620. Thus the filter can be maintained clean for extended period as compared with the prior art, which advantageously reduces the need for cleaning or changing the filter.

Reference has been made in detail to the preferred embodiments of the present disclosure, examples of which are illustrated in the accompanying drawings. While the disclosure is described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the detailed description of embodiments of the present disclosure, numerous specific details have been set forth in order to provide a thorough understanding of the present disclosure. However, it will be recognized by one of ordinary skill in the art that the present disclosure may be practiced without these specific details. In other instances, well-known methods, procedures, components, and circuits have not been described in detail so as not to unnecessarily obscure aspects of the embodiments of the present disclosure. The drawings showing embodiments of the disclosure are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the disclosure can be operated in any orientation.

Although certain preferred embodiments and methods have been disclosed herein, it will be apparent from the foregoing disclosure to those skilled in the art that variations and modifications of such embodiments and methods may be made without departing from the spirit and scope of the disclosure. It is intended that the disclosure shall be limited only to the extent required by the appended claims and the rules and principles of applicable law.

What is claimed is:

1. A washing machine comprising:

a washing tub configured to contain washing water, the washing tub comprising: an outflow port to allow washing water to flow out of the washing tub; and an inflow port comprising an opening to allow washing water to flow in the washing tub;

a drain port comprising an opening for draining washing water of the washing machine;

a filter; and a branch part containing the filter and wherein the branch part comprises: a first port coupled to the inflow port; a circulation device accommodation member comprising a second port that is coupled to the outflow port; and a third port coupled to the drain port, wherein the branch part further comprises a filter mount for coupling the filter to the branch part, wherein the filter mount is disposed on one end of the branch part, wherein the branch part further comprises a drain device accommodation member, and further comprising a drain device coupled to the branch part through the drain device accommodation member and configured to drive washing water to flow from the branch part to the drain port, wherein the drain device accommodation member is disposed on an opposite end of the branch part than the filter mount, wherein the filter comprises a filter bar extending from a side of the filter mount toward the drain device accommodation member, wherein the filter further comprises a discharge member disposed at a side of the drain device accommodation member and having a discharge hole, and wherein the filter bar is inserted into the discharge hole of the discharge member.

2. The washing machine of claim 1 further comprising a circulation device coupled to the branch part through the circulation device accommodation member and configured to drive washing water from the branch part to the washing tub.

3. The washing machine of claim 2, wherein the filter comprises a filtering member disposed on a side of the circulation device accommodation member.

4. The washing machine of claim 1, wherein the circulation device accommodation member is disposed on a first side of a side wall of the branch part, and wherein the first port is disposed on a second side of the side wall of the branch part that is opposite to the first side.

5. The washing machine of claim 1, wherein washing water is supplied from the branch part to the drain port without passing through the filter in a water drain process.

6. The washing machine of claim 1, wherein washing water passes through the filter before passing through the circulation device accommodation member in a water circulation process.

7. A washing machine comprising:

a washing tub operable to contain washing water;

a drain port comprising an opening through which washing water is drained out of the washing machine;

a circulation device configured to drive water from a branch part back to the washing tub; and a drain device configured to drive water from a branch part to outside the washing machine;

a filter, wherein the branch part is coupled to the circulation device and the drain device, wherein the branch part contains the filter, wherein, in a water drain process, washing water discharged from the washing tub flows through the branch part to the drain port without passing through the filter, and wherein further, in a water circulation process, washing water discharged from the washing tub passes through the filter before entering the circulation device through the branch part, wherein the branch part further comprises a drain device accommodation member, and wherein the filter comprises: a filter bar extending from the side of a filter mount toward the drain device accommodation member; and a discharge member disposed at a side of the drain device accommodation member and comprises a discharge hole, and wherein the filter bar is inserted into the discharge hole of the discharge member.

8. The washing machine of claim 7, wherein the branch part comprises a filter accommodation member configured to removably accommodate the filter.

9. The washing machine of claim 8, wherein the washing tub comprises: an outflow port through which washing water flows out of the washing tub and an inflow port through which washing water flowing out from the outflow port is returned to the washing tub.

10. The washing machine of claim 9, wherein the branch part comprises a circulation device accommodation member configured to couple the circulation device to the branch part; a first port coupled to the outflow port; a second port coupled to the inflow port and disposed in the circulation device accommodation member; and a third port coupled to the drain port.

11. The washing machine of claim 10, wherein the filter comprises a first positioning portion, wherein the filter accommodation member comprises a second positioning portion analogous to the first positioning portion, and wherein the first positioning portion and the second positioning portion are operable to prevent rotation of a filter member of the filter when the filter is mounted to or demounted from the filter accommodation member.

12. The washing machine of claim 11, wherein the filter member is disposed at a side of the circulation device accommodation member.

13. The washing machine of claim 11, wherein the filter bar and the discharge hole are configured to prevent extraneous material in washing water from entering the drain device accommodation member.

14. The washing machine of claim 11, wherein the drain device accommodation member is disposed on an opposite end of the branch part than the filter mount.

* * * * *